United States Patent [19]

Valdez

[11] 4,222,301

[45] Sep. 16, 1980

[54] MAGNETIC PICKUP ARRANGEMENT FOR STRINGED MUSICAL INSTRUMENT

[76] Inventor: Arthur F. Valdez, 7420 Sunset Blvd., Los Angeles, Calif. 90046

[21] Appl. No.: 870,133

[22] Filed: Jan. 17, 1978

[51] Int. Cl.[3] ..... G10H 3/08; G10H 3/18

[52] U.S. Cl. ..... 84/1.15; 84/1.16

[58] Field of Search ..... 84/1.15, 1.16

[56] References Cited

U.S. PATENT DOCUMENTS

| | | | |
|---|---|---|---|
| 2,896,491 | 7/1959 | Lover | 84/1.15 |
| 3,249,677 | 5/1966 | Burns et al. | 84/1.16 |
| 3,290,424 | 12/1966 | Fender | 84/1.16 |
| 3,472,943 | 10/1969 | Kawabata et al. | 84/1.15 |
| 3,915,048 | 10/1975 | Stich | 84/1.15 X |
| 3,962,946 | 6/1976 | Rickard | 84/1.15 |

*Primary Examiner*—S. J. Witkowski

*Attorney, Agent, or Firm*—Thomas A. Fournie

[57] ABSTRACT

An improved magnetic induction type pickup arrangement incorporated in an electric guitar having a pair of three-coil magnetic type pickup units operable to produce enhanced outputs. The electric guitar includes a switching mechanism for selectively controlling the connection of the three-coil pickup units across the guitar's electric amplifier.

10 Claims, 4 Drawing Figures

MAGNETIC PICKUP ARRANGEMENT FOR STRINGED MUSICAL INSTRUMENT

BACKGROUND OF THE INVENTION

The present invention relates to magnetic induction type pickups for electrical guitars and other stringed musical instruments, and more particularly to an improved magnetic induction type pickup arrangement for such instruments capable of generating an enhanced output signal.

Heretofore, such magnetic induction type pickups have been devised employing a plurality of permanent magnet cores or pole pieces, one for each instrument string or set of strings, surrounded by a single common generating coil. Further, pickup units have been devised by interconnecting the coils of two such single coil pickups to form a single pickup unit.

SUMMARY OF THE INVENTION

Surprisingly and unexpectedly, it has been discovered that an improved magnetic induction type pickup unit can be formed by interconnecting the coils of three such prior art pickups, such improved pickup unit having an enhanced output which more than proportionately exceeds the output of a pickup unit having the common coils of two of such pickups similarly connected. That is to say, the improved three-coil magnetic induction type pickup unit according to the present invention is surprisingly operative to produce an output signal which exceeds by more than 50% the output signal of a similarly connected two-coil pickup unit.

Accordingly, it is an object of the present invention to provide improved magnetic inductive type pickup arrangements for electrical guitars and other stringed musical instruments employing the aforementioned discovery.

In accomplishing these and other objects, there is provided an electric guitar having two improved three-coil pickup units disposed adjacent the guitar strings in a longitudinally spaced apart disposition. Switch means are provided for selectively controlling the connection of the improved three-coil pickup units across the input terminals of the guitar's amplifier.

Additional objects of the present invention reside in the specific construction of the exemplary embodiments thereof hereinafter described in conjunction with the several drawing figures.

DETAILED DESCRIPTION OF THE PREFERRED EMBODIMENTS

Figure 1:
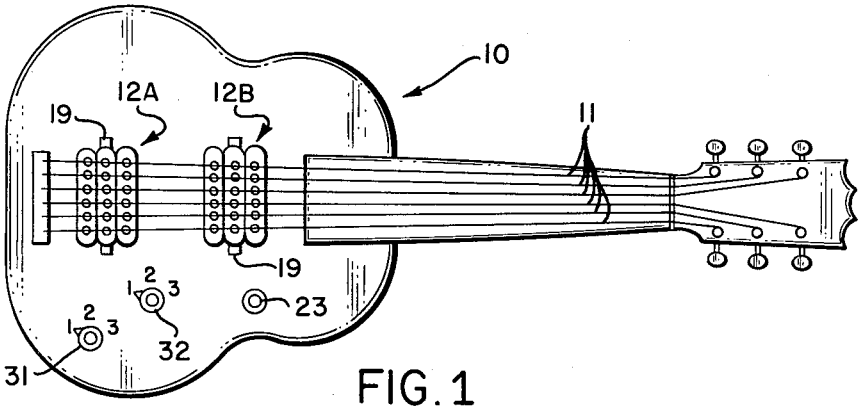
FIG. 1 is a top plan view of an electric guitar having an improved magnetic pickup arrangement according to the present invention.

Referring to the drawings, there is provided in FIG. 1 an electric guitar generally identified by the numeral 10. The guitar 10 has six wire strings 11 atrung in a conventional manner and two magnetic induction type pickup units 12A and 12B constructed in accordance with the present invention. The units 12A and 12B are each mounted in a conventional manner on the guitar 10 by bracket structure 19.

Figure 2:
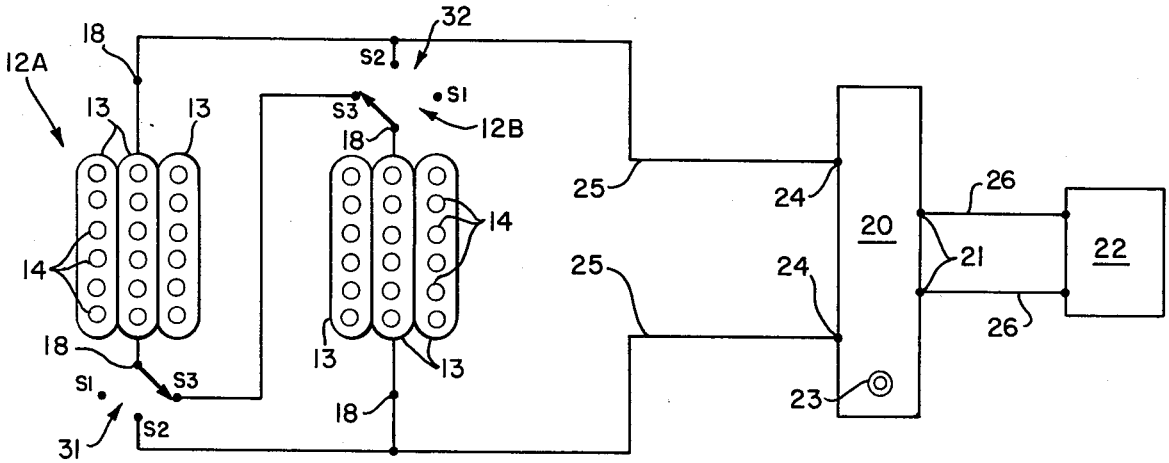
FIG. 2 is a circuit diagram of the electric guitar of FIG. 1, illustrating the switching arrangement interconnecting the two three-coil magnetic pickup units included therein.
Figure 3:
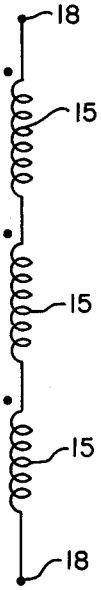
FIG. 3 is a circuit diagram of a three-coil magnetic pickup unit of FIGS. 1 and 2, illustrating the coils therein connected in series.

As shown in FIGS. 1 and 2, each of the pickup units 12A and 12B is made up of three side by side oval-shaped pickups 13. The oval-shaped pickups 13 are positioned adjacent each other with their longitudinal axes in a substantially mutually parallel disposition. Each oval-shaped pickup 13 has six similarly disposed magnet cores or pole pieces 14, one associated with and disposed below each of the strings 11, surrounded by a common oval generating coil 15. It is noted that each of the pole pieces 14 is positioned to have its longitudinal axis extending normal to the face of the pickups 13, and that the pickups 13 are mounted beneath the strings 11 with their faces positioned substantially parallel to the plane of the strings 11. Thus, the pole pieces 14 in situ are positioned parallel to each other and normal to the string 11 with which they are associated. As shown in FIG. 3, the common oval operating coils 15 may be connected in series between coil terminals 18 with the polarity of the coils 15 in phase so that the fields they generate add and combine to reinforce each other. This series in phase manner of coil connection shown in FIG. 3 is believed to be the preferred form for practicing the present invention.

Figure 4:
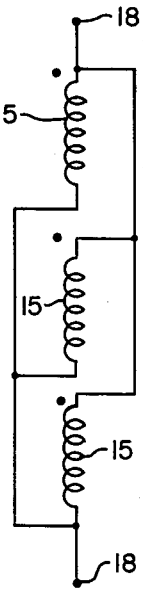
FIG. 4 is a circuit diagram illustrating an alternate parallel connection of the coils making up a three-coil magnetic pickup unit of FIGS. 1 and 2.

FIG. 4 shows an alternate manner for connecting the common oval operating coils 15 of the units 12A and 12B. As there shown, the coils 15 are connected in parallel between the coil terminals 18 with the polarity of the coils 15 in phase so that the fields they generate combine to reinforce each other.

The guitar 10 includes an output amplifier 20 having output terminals 21 for connection to a loud speaker 22. In FIG. 2, the loudspeaker 22 is shown connected across the amplifier output terminals 21 by electrical leads 26. The amplifier 20 has a volume control which is generally identified by the numeral 23.

The amplifier 20 has input terminals 24 to which are connected input leads 25. A switching mechanism made up of three-position switches 31 and 32 is included in the guitar 10 for selectively controlling the connection of the three-coil pickup units 12A and 12B across the input terminals 24 of the amplifier 20.

Each of the switches 31 and 32 has three positions identified by the designations S1, S2 and S3. With both of the switches 31, 32 switched to their position S1, neither of the pickup units 12A, 12B are connected across the amplifier input terminals 24 since as shown in FIG. 2 each of the switches 31 and 32 in their switch positions S1 have their movable contact switched to a dummy contact which is an electrical dead end not interconnected with the amplifier 20. With the movable contact of switch 31 switched to position S2 and the movable contact of switch 32 switched to switch position S1 or S3, the pickup unit 12A is only connected across the amplifier input terminals 24. Such occurs since, as shown in FIG. 2, switching of the switch 31 to its switch position S2 connects the three-coil pickup unit 12A directly between the leads 25 and hence across the amplifier input terminals 24. At the same time, if the switch 32 has its movable contact switched to its switch position S1, there will be no electrical path through the three-coil pickup unit 12B since same will dead end electrically on the S1 dummy contact of the switch 32. Likewise, if the switch 32 has its movable contact switched to its switch position S3, the electrical path through the three-coil pickup unit 12B dead ends electrically on switch contact S3 of the switch 31 since the movable contact of the switch 31 will not be switched to its switch contact S3, but rather to its contact S2. Similarly, if switch 32 is switched to position S2 and switch 31 is either in position S1 or S3, then only the pickup unit 12B is connected to drive the amplifier 20. The pickup units 12A, 12B are connected in parallel in phase when the switches 31, 32 are both switched to position S2 and in series in phase when the switches 31, 32 both have their movable contacts switched to positions S3. This is true since with the switches 31, 32 both switched to position S2 both of the three-coil pickup units 12A, 12B will be connected between the leads 25, and hence in parallel across the amplifier input terminals 24. On the other hand, when the movable contacts of each of the switches 31, 32 are switched to switch positions S3, as shown in FIG. 2, an in series electrical path exists in such situation from the lowermost shown amplifier input terminal 24 through the lead 25 connected thereto, the three-coil pickup 12B, the movable contact of the switch 32, the fixed contact S3 of the switch 32, the fixed contact S3 of the switch 31, the movable contact of the switch 31, the three-coil pickup unit 12A and the lead 25 connected to the uppermost shown amplifier input terminal 24. It is noted as hereinbefore mentioned and described that the in phase interconnection of the three oval common coils 15 of each of the pickup units 12A and 12B can be either in series as shown in FIG. 3, or alternately in parallel as shown in FIG. 4.

In operation of the electric guitar 10, the vibration of each string 11 is sensed by the magnetic pole pieces 14 positioned adjacent thereto. Thereby, corresponding electric fields are induced in the coils 15 of the pickups 12A, 12B. Depending on the positioning of the switches 31, 32, the enhanced output signals generated by the pickups 12A, 12B are coupled to drive the amplifier 20. The amplifier 20 in turn amplifies these enhanced output signals and drives the loudspeaker 22 to generate music.

It is noted that the pickup units 12A, 12B are positioned spaced apart longitudinally along the strings 11 so that each will pick up different tones. Thus, by use of the switches 31 and 32, a variety of so-called tone colors of surprisingly enhanced output volume can be produced by the guitar.

Thus, an improved magnetic induction type three-coil pickup arrangement has been provided for electric guitars and other stringed instruments. While the invention has been described in what is presently considered to be its preferred embodiments, it is recognized that departures may be made therefrom in the spirit and scope of the invention defined by the claims hereinafter set forth.

I claim:

1. A three-coil magnetic induction type pickup unit for electrical guitars and other stringed musical instruments, comprising:

three similarly constructed substantially oval shaped magnetic pickups disposed side by side abutting each other in a substantially mutually parallel relationship;

each of said three-magnetic pickups having a plurality of similarly disposed separate spaced apart substantially mutually parallel magnetic pole pieces, the number of said pole pieces corresponding to the number of instrument strings with which said pickup unit is to be used and each of said pole pieces being situated spaced apart for positioning adjacent a different one of such instrument strings, each of said three magnetic pickups also having a single common substantially oval shaped coil surrounding said plurality of pole pieces whereby magnetic fields generated in said pole pieces by string movement induce corresponding electrical signals in said common coils;

a pair of coil output terminals; and means for electrically interconnecting said common coils of said three magnetic pickups between said coil output terminals, said interconnecting means electrically interconnecting said three common coils in phase whereby said in phase connected three common coils operate to produce an enhanced output signal across said pair of coil output terminals.

2. The invention defined in claim 1, wherein said three common coils are connected between said pair of coil output terminals in series with each other.

3. The invention defined in claim 1, wherein said three common coils are connected between said pair of coil output terminals in parallel with each other.

4. The invention defined in claim 1, including means for mounting said three-coil pickup unit on an electrical guitar or other stringed musical instrument.

5. The invention defined in claim 1, including:

two of said three-coil pickup units defined in claim 1;

means for mounting each of said three-coil pickup units on an electrical guitar or other stringed musical instrument adjacent its strings in a longitudinal spaced apart disposition;

a pair of other output terminals; and switch means for selectively interconnecting said three-coil pickup units across said other output terminals either alone, in series or in parallel.

6. The invention defined in claim 5 in combination with:

amplifier means having input and output terminals;

a loudspeaker;

means for connecting said other output terminals with said amplifier input terminals to supply the signal generated across said other output terminals as an input to said amplifier means; and means for connecting said loudspeaker across said amplifier output terminals whereby said loudspeaker is driven by said amplifier means.

7. The invention defined in claim 6, wherein said common coils of each of said three-coil pickup units are connected in series with each other.

8. The invention defined in claim 6, wherein said common coils of each of said three-coil units are connected in parallel with each other.

9. The invention defined in claim 5, wherein said common coils of each of said three-coil pickup units are connected in series with each other.

10. The invention defined in claim 5, wherein said common coils of each of said three-coil pickup units are connected in parallel with each other.

* * * * *

UNITED STATES PATENT OFFICE

CERTIFICATE OF CORRECTION

Patent No. 4,222,301 Dated 16 September 1980

Inventor(s) ARTHUR F. VALDEZ

It is certified that error appears in the above-identified patent and that said Letters Patent are hereby corrected as shown below:

In column 2, line 1, "atrung" should be --strung--; and

In column 2, line 23, "operating" should be --generating --.

Signed and Sealed this

Tenth Day of March 1981

[SEAL]

Attest:

RENE D. TEGTMEYER

Attesting Officer

Acting Commissioner of Patents and Trademarks